US006698831B2

(12) United States Patent
Lloyd

(10) Patent No.: US 6,698,831 B2
(45) Date of Patent: Mar. 2, 2004

(54) ADJUSTABLE CHAIR

(76) Inventor: John T. Lloyd, 80926 Turkey Run Rd., Creswell, OR (US) 97426

( * ) Notice: Subject to any disclaimer, the term of this patent is extended or adjusted under 35 U.S.C. 154(b) by 0 days.

(21) Appl. No.: 09/731,299

(22) Filed: Dec. 5, 2000

(65) Prior Publication Data

US 2002/0067060 A1 Jun. 6, 2002

Related U.S. Application Data

(60) Provisional application No. 60/219,747, filed on Jul. 20, 2000.

(51) Int. Cl.[7] ..... A47C 1/02
(52) U.S. Cl. ..... 297/195.11; 297/423.11
(58) Field of Search ..... 297/195.11, 423.11, 297/423.12, 488; 482/134, 136, 137, 138; 5/630

(56) References Cited

U.S. PATENT DOCUMENTS

| | | | | |
|---|---|---|---|---|
| 3,067,975 A | | 12/1962 | Wilcox | |
| 4,650,249 A | * | 3/1987 | Serber | 297/313 |
| 4,662,361 A | * | 5/1987 | Patterson | 601/24 |
| 4,746,167 A | | 5/1988 | Palmer et al. | |
| 4,971,040 A | | 11/1990 | Gillotti | |
| 5,177,823 A | * | 1/1993 | Riach | 5/636 |
| 5,215,282 A | * | 6/1993 | Bonutti | 248/118 |
| 5,295,728 A | * | 3/1994 | Schaevitz | 297/195.1 |
| 5,304,107 A | * | 4/1994 | Jones | 482/98 |
| 5,401,078 A | | 3/1995 | Riach | |
| 5,427,436 A | * | 6/1995 | Lloyd | 297/408 |
| 5,484,151 A | * | 1/1996 | Tholkes | 280/250.1 |
| 5,487,590 A | * | 1/1996 | Haynes | 297/344.14 |
| 5,545,177 A | * | 8/1996 | Coseo | 606/204 |
| 5,762,402 A | | 6/1998 | Gillotti | |
| 5,762,618 A | | 6/1998 | Yamanaka et al. | |
| 5,792,082 A | | 8/1998 | Yamanaka et al. | |
| 5,813,727 A | * | 9/1998 | Sugawa et al. | 297/411.42 |
| 5,827,206 A | | 10/1998 | Lunter | |
| D402,479 S | | 12/1998 | Inada | |
| 5,921,696 A | | 7/1999 | Gillotti | |
| 5,971,485 A | * | 10/1999 | Clark | 297/423.12 |
| 6,065,808 A | | 5/2000 | Tinsley | |

* cited by examiner

*Primary Examiner*—Peter M. Cuomo
*Assistant Examiner*—Joseph Edell
(74) *Attorney, Agent, or Firm*—Kolisch Hartwell, P.C.

(57) ABSTRACT

A collapsible chair for supporting a person includes a seat and a chest rest. The chest rest may be adjusted longitudinally and rotationally when a cam lever is moved into an unlocked position. An adjustable face rest is connected to the chest rest. The chair may also include an adjustable armrest, and detachable knee rests.

12 Claims, 7 Drawing Sheets

ADJUSTABLE CHAIR

CROSS-REFERENCE TO RELATED APPLICATION

This application claims priority from U.S. Provisional Patent Application Serial No. 60/219,747, filed Jul. 20, 2000, which is hereby incorporated by reference.

FIELD OF THE INVENTION

The invention relates to an adjustable chair for supporting a person while receiving body-working therapy, particularly back and/or neck massage.

BACKGROUND OF THE INVENTION

Massage is often performed on a person who sits in a chair so that the person's back faces the therapist. These types of chairs typically employ a chest rest and a face rest so that the person can sit in a relaxed forward-leaning position during a body working procedure. Examples of such chairs are shown in U.S. Pat. Nos. 4,746,167, 5,401,078, 5,762,402, and 6,065,808. Each of these patents is incorporated here by reference.

It is important for body-working chairs to be highly adjustable because of variability in body size and anatomy, and because of variations in the types of procedures that may be carried out. Some chest supporting chairs for massage have insufficient degrees of adjustability to accommodate a wide range of body sizes, positions, and procedures.

Another problem with prior chairs is that they require the therapist to work in an awkward, unstable, or unhealthy position. Thus, proper adjustment of the chair is important for the therapist as well as for the massage recipient.

Another problem with prior chairs is that sometimes the adjustment mechanisms are overly complex so that it is difficult to figure out how to change the orientation of the chair to suit the particular situation.

Another problem with prior chair designs is that some chairs may become unstable when they are adjusted into certain positions.

Further, it is desirable to address the problems mentioned above in a chair design that is lightweight and collapsible so that it can be easily transported and stored.

SUMMARY OF THE INVENTION

The invention provides an adjustable lightweight chair for supporting a person in a position that presents a person's back for conducting a massage or other type of therapy. The chair has a seat supported by a rear leg framework. A front leg structure has an upper portion. A first transverse axis is defined substantially perpendicular to the upper portion of the front leg structure. A clamp device connects a substantially planar padded chest rest to the front leg structure. The clamp device has a lock position and an unlock position. When the clamp device is in the lock position the chest rest is free to move longitudinally and rotationally relative to the transverse axis. Movement of the chest rest relative to the transverse axis is prevented when the clamp device is in the lock position.

In a preferred embodiment of the invention the clamp device is operated between the lock and unlock positions by operating a single cam lever or handle. The handle is symmetrically located along the transverse axis relative to the chest rest. An adjustable face rest is connected to the chest rest. A slide mechanism permits alteration of the distance between the chest rest and the face rest. A second clamp device permits adjustment of the face rest in accordance with U.S. Pat. No. 5,427,436, and U.S. patent application Ser. No. 09/599,290, filed Jun. 21, 2000, each of which is hereby incorporated by reference.

BRIEF DESCRIPTION OF THE FIGURES

FIG. 4 shows the clamp mechanism unlocked. FIG. 5 shows the clamp mechanism locked.

DESCRIPTION OF PREFERRED EMBODIMENTS OF THE INVENTION

The invention includes numerous design features that may be combined in different ways to produce lightweight collapsible chairs that are easily adjusted into different positions for different applications. Examples of preferred embodiments of the invention are shown in the figures and described below.

Figure 1:
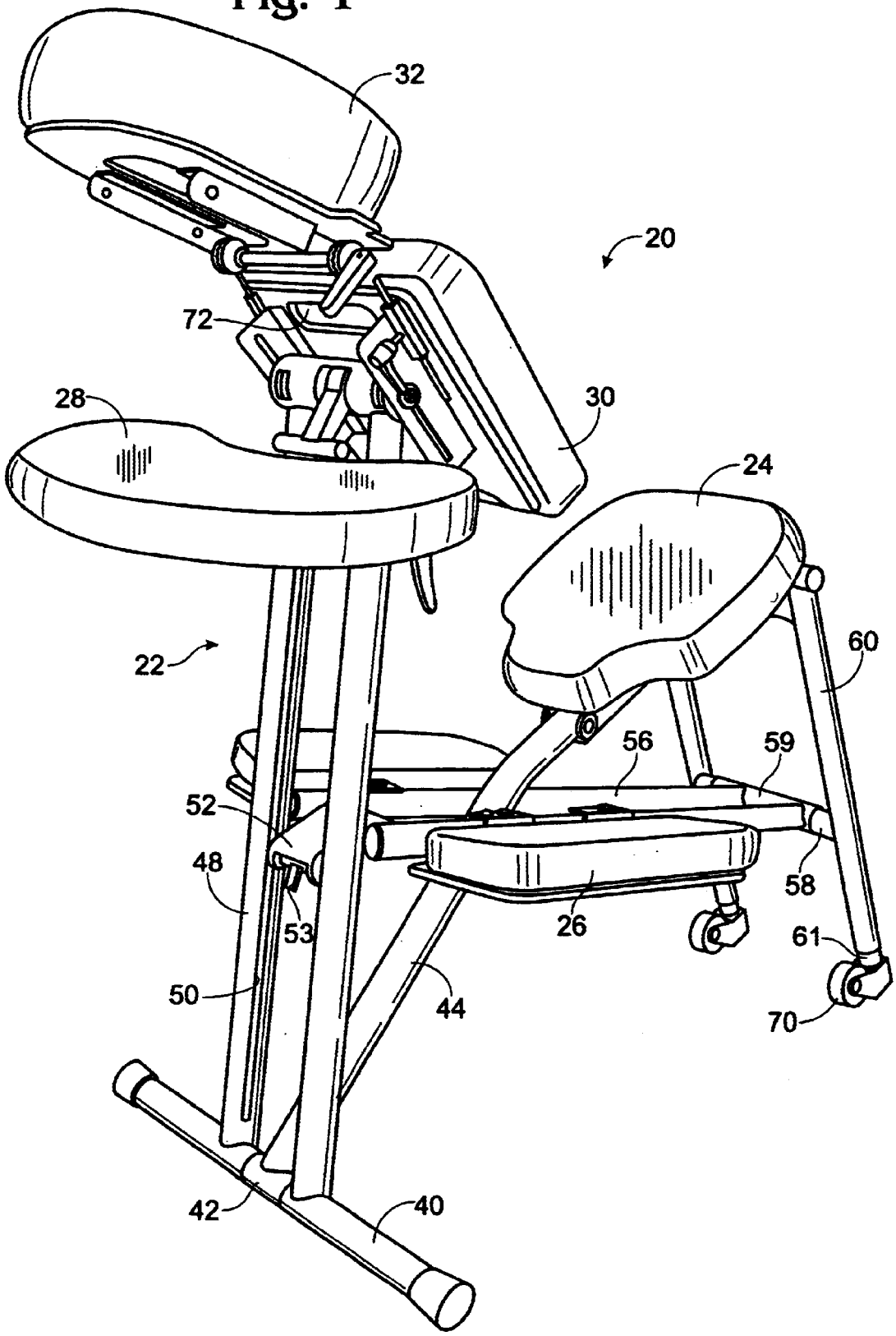
FIG. 1 is a perspective view of a chair.

FIG. 1 shows a chair including numerous adjustment mechanisms allowing configuration of the chair to be customized for a particular person. Chair 20 is particularly well suited for supporting a person who is receiving massage or other body-working therapy on the back, upper shoulders, or neck.

Chair 20 is generally supported by a lightweight primary frame 22. Frame 22 supports seat 24, a pair of detachable knee rests 26, arm rest 28, chest rest 30, and face rest 32.

Frame 22 is partially stabilized by front cross support 40. Front cross support 40 has a central front pivot section 42 that is rigidly connected to diagonal support member 44. A pair of parallel front leg members 48 extend upward from front cross support 40. Each of front leg members 48 have an inside slot or groove 50 that engages opposite sides of coupling member 52.

Figures 9A, 9B, 9C:
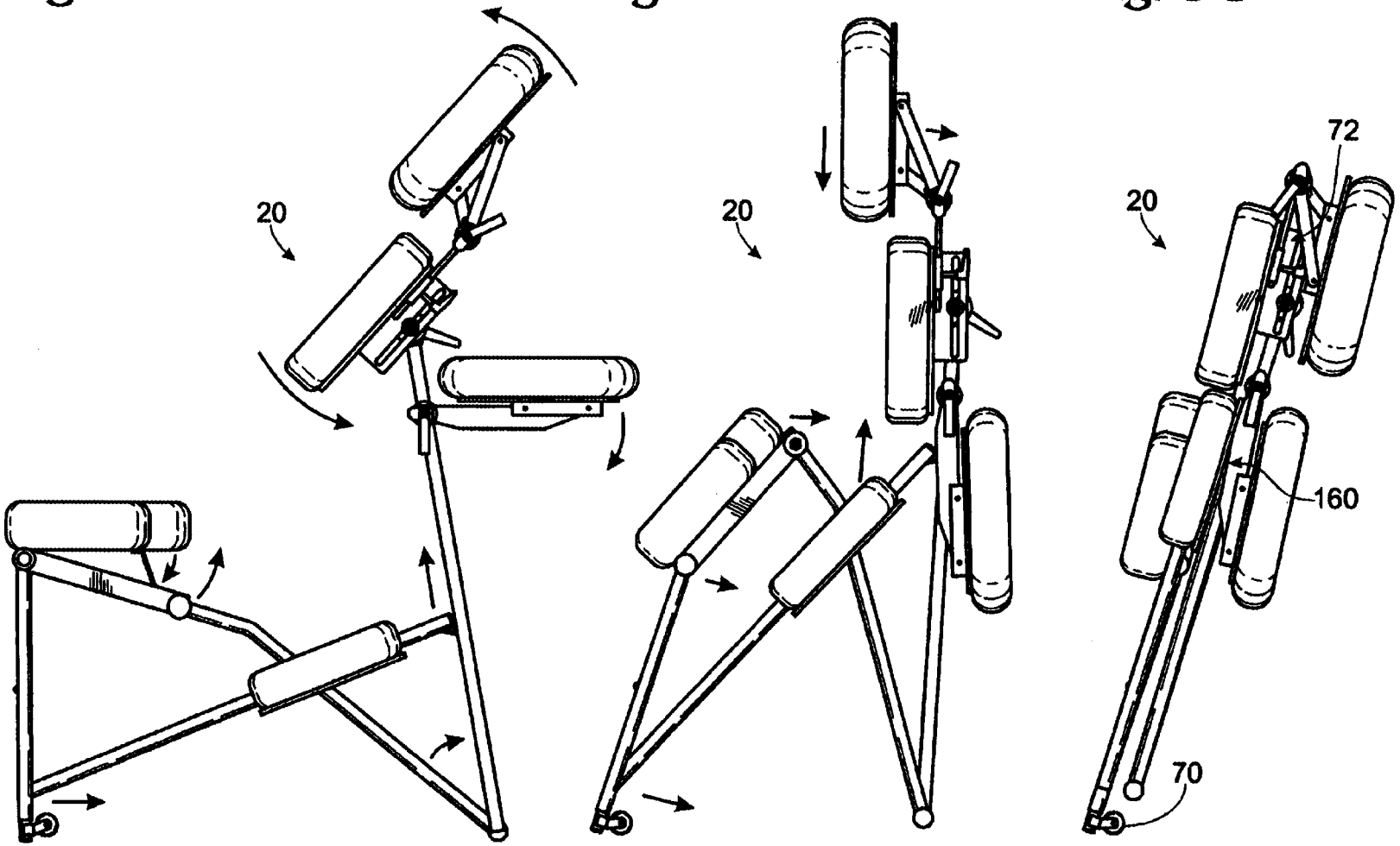
FIGS. 9A–C are side views of a chair in setup, partially collapsed, and collapsed positions.

When chair 20 is set up, coupling member 52 is locked in a central location in slots 50, as shown in FIG. 1. Manipulation of toggle 53 unlocks coupling member 52 with respect to leg members 48 so that it can slide within slots 50, thereby allowing chair 20 to be collapsed, as shown in FIGS. 9A–C.

A pair of parallel transverse supports 56 connect coupling member 52 to diagonal support member 44, and to rear cross support 58. Rear cross support 58 has a rear pivot section 59 that rotates relative to rear leg members 60 when chair 20 is collapsed. A pair of wheels 70 are provided at distal ends of extension members 61 of rear leg members 60. Wheels 70 are raised above the ground when chair 20 is set up. As shown in FIGS. 10A–C, wheels 70 contact the ground for easy transport when chair 20 is collapsed and leaned forward. When chair 20 is collapsed aperture 72 behind chest rest 30 may be used as a handle to pull the collapsed chair in an orientation that causes the chair to ride stably on wheels 70.

Figure 2:
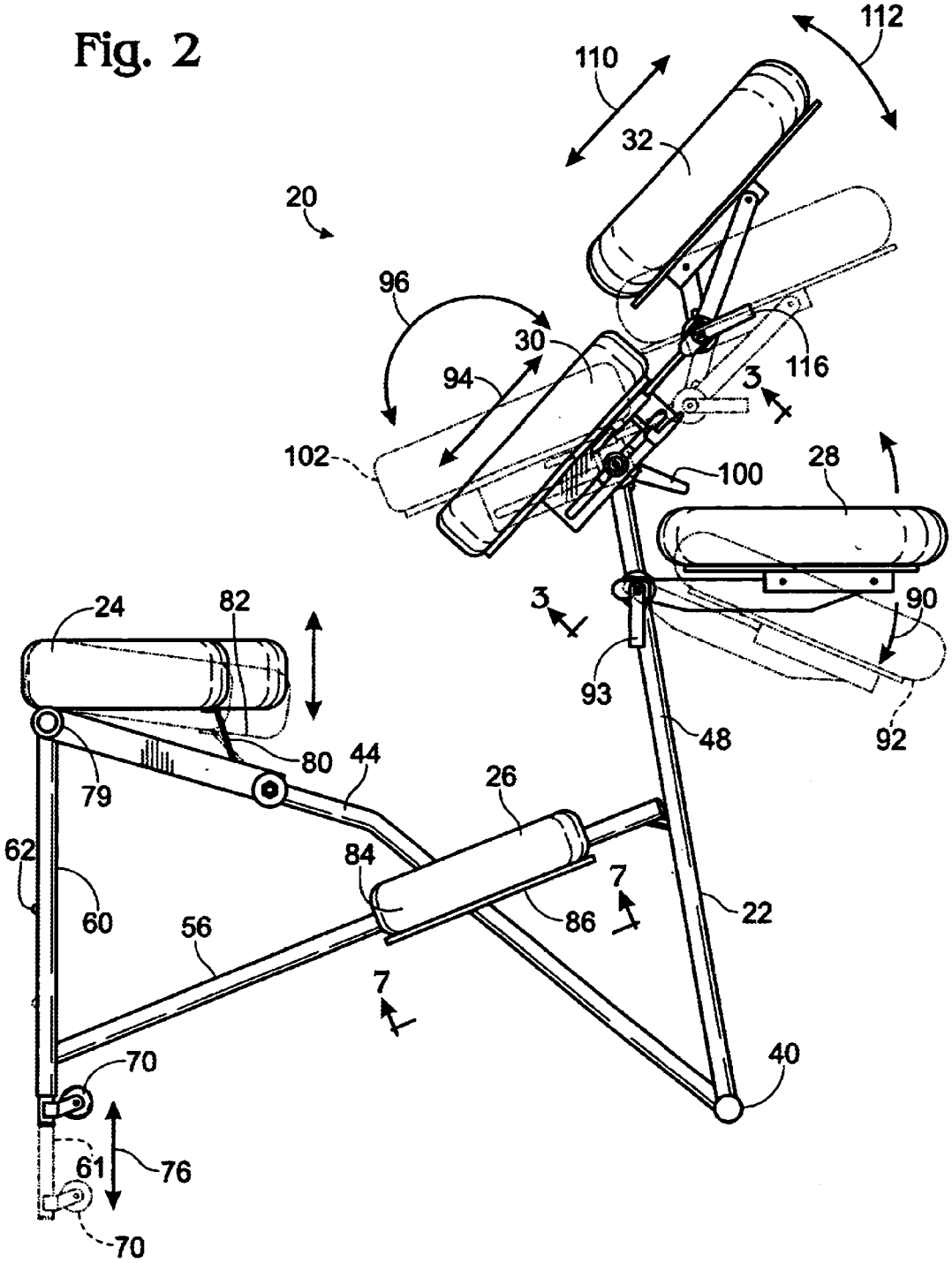
FIG. 2 is a side view of the chair shown in FIG. 1. Alternative chair positions are shown in dashed lines.

FIG. 2 shows a side view of chair 20. Arrows and dashed lines are used to illustrate various adjustment mechanisms provided on chair 20. Rear leg members 60 may be extended by telescoping action so that wheel 70 moves in direction 76 to an extended position as shown in FIG. 2.

Seat 24 may be leveled by moving seat 24 around pivot 79 and securing strut 80 in an appropriate slot. FIG. 2 shows seat 24 in a second adjusted position 82.

Knee rest 26 may be removed by a mechanism described below, so that a person can place their feet on the floor. Knee rest 26 includes two components, namely, pad 84 mounted on top of planar rigid base 86.

Armrest 28 may be rotated in direction 90 to position 92 by manipulating handle 93 to an unlocked position. Once armrest 28 is adjusted to the desired position, further movement is prohibited by manipulating lever 93 to the locked position.

Chest rest 30 is free to move longitudinally in direction 94, and rotationally in direction 96 when lever 100 is in the unlocked position. Accordingly, chest rest 30 may be adjusted to an infinite number of different positions, such as position 102.

Face rest 32 may be moved longitudinally in direction 110, and rotationally in direction 112, when lever 116 is in the unlocked position. The face rest adjustment mechanism employed in chair 20, as shown in FIG. 2, is described in further detail in U.S. Pat. No. 5,427,436, and U.S. patent application Ser. No. 09/599,290, filed Jun. 21, 2000, both of which are hereby incorporated by reference.

Extension members 61 telescope from rear leg members 60, and may be locked into position by operation of push pin 62.

FIGS. 3–6 illustrate details of the clamp mechanism used to provide adjustability for chest rest 30. Aspects of the chest rest clamp device are generally symmetrical with pairs of components being provided on opposite sides of the chest rest. For simplicity, reference numbers and discussion may be limited to one side of the clamp. The drawings clearly indicate which of the described components have undescribed counterparts, and which components are singular. For example, it will be noted that most of the clamp devices employed in chair 20 are operable by manipulating a single lever or handle.

Figure 3:
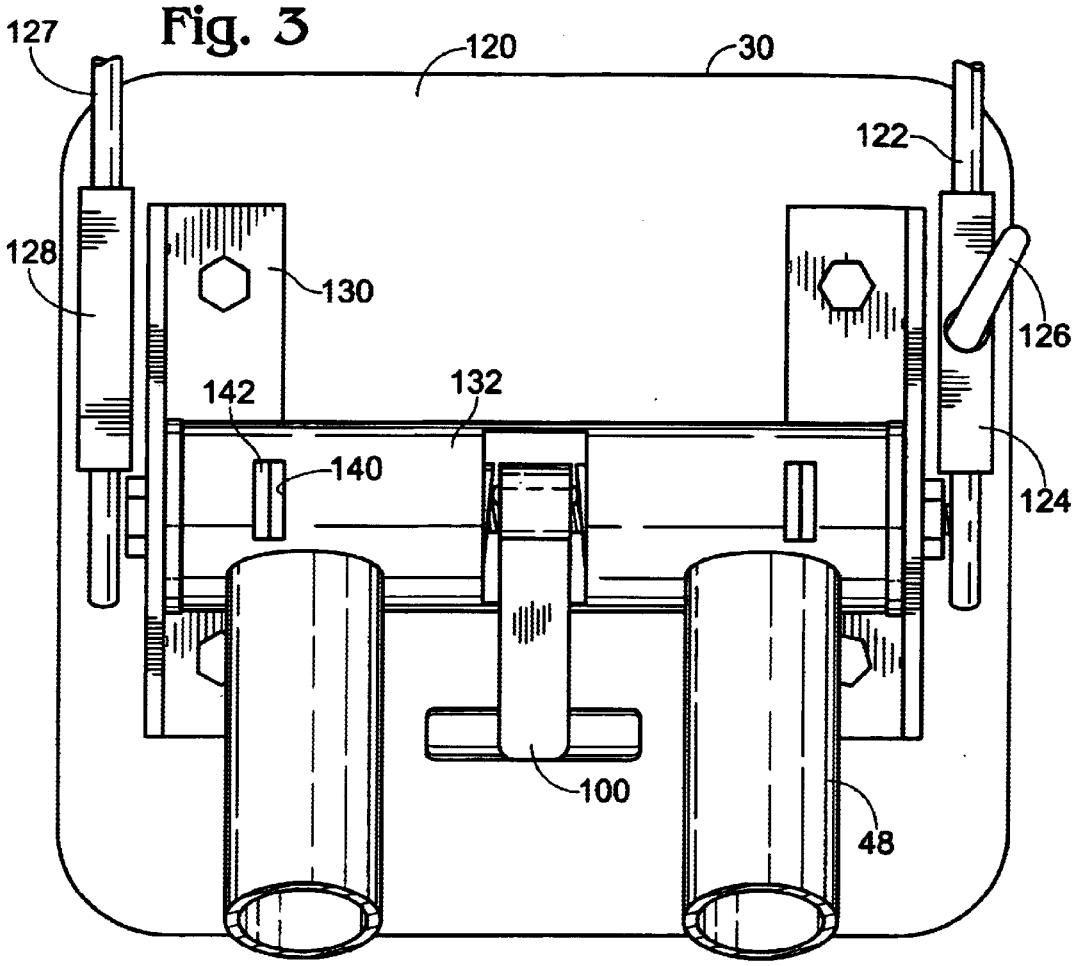
FIG. 3 is a rear view, from the perspective of line 3—3 in FIG. 2, of the chest rest shown in FIGS. 1 and 2.

FIG. 3 shows a rear view of chest rest 30. The adjustable clamp device is secured to rigid base plate 120. Rod 122 from face rest 32 is secured to base plate 120 through guide 124. Lever 126 can be manipulated to prevent movement of rod 122 relative to guide 124. Alternatively, lever 126 can be manipulated to free movement of rod 122 in guide 124. On the other side of chest rest 30 rod 127 is moveable in guide 128. A leaf spring (not shown) secures rod 127 in guide 128.

Mounting brackets 130 are bolted onto the face of base plate 120. Mounting brackets 130 each have a longitudinal slot as shown in FIGS. 1 and 2. Clamp housing 132 contains the clamp device. Aperture 140 is provided in housing 132. Anti-rotation bar 142 has a portion that protrudes from aperture 140.

Figure 4:
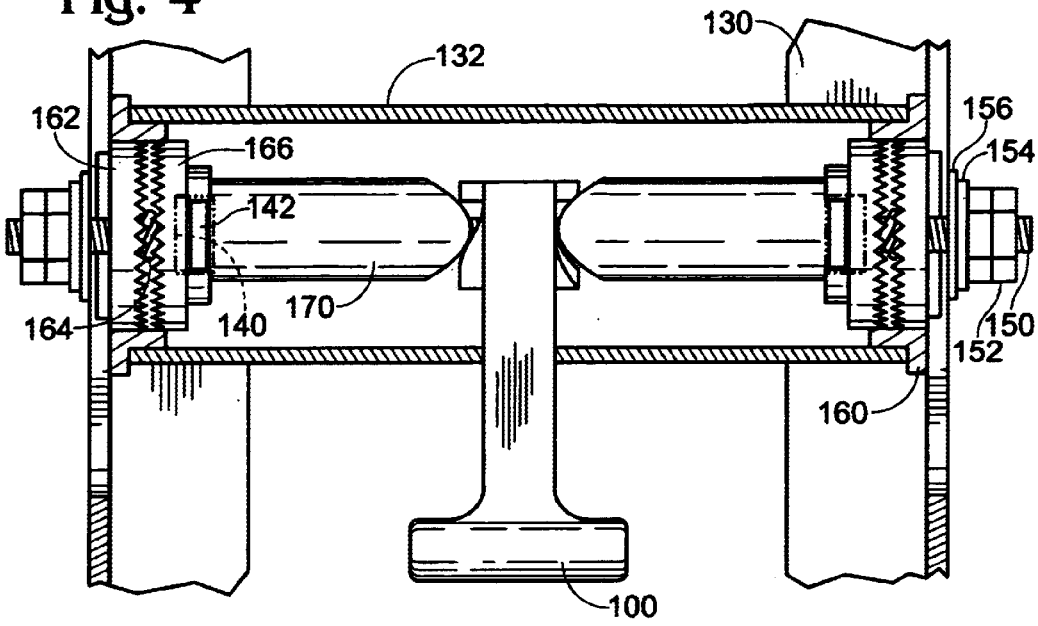
FIGS. 4 and 5 are partial cut-away views of the clamp mechanism used to provide adjustability for the chest rest.
Figure 5:
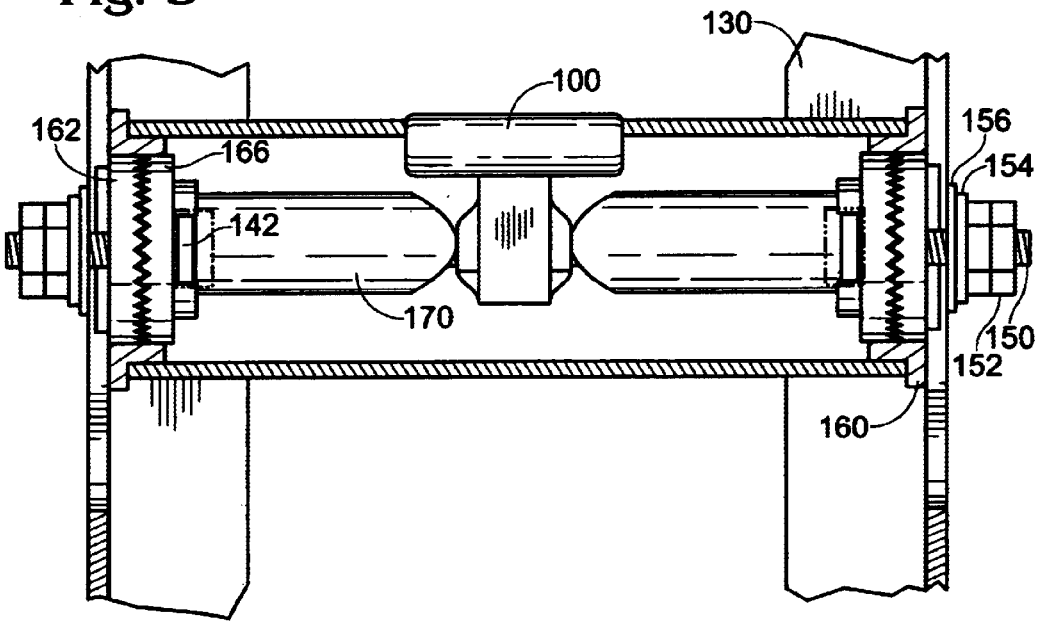

FIG. 4 shows details of the chest rest clamp that are contained inside housing 132. Rod 150 extends through housing 132. Nuts 152 secure rod 150 relative to mounting brackets 130. Steel washers 154 and nylon washers 156 are positioned on the outside of mounting brackets 130. Flanged washers 160 are provided on the insides of mounting brackets 130. Two pairs of locking discs are arranged with opposing teeth configurations so that engagement and disengagement of each pair of locking discs provides rotational locking, and freedom, respectively. Each pair of discs has an outside locking disc 162 that is rotationally fixed relative to a respective mounting bracket 130 by a tab engaging a slot in bracket 130. Spring 164 separates outside locking disc 162 from inside locking disc 166 so that the discs are urged apart when lever 100 is in the unlocked position. Cam followers 170 are configured so that movement of lever 100 between unlocked and locked positions causes each inside locking disc 166 to engage and disengage the respective outside locking disc 162. Movement of cam followers 170 toward outside locking discs 162 causes anti-rotation bars 142 to move from the inside portion of aperture 140 to the outside portion of aperture 140. In FIGS. 4 and 5 the aperture in housing 132 is shown in dashed lines. FIG. 5 shows the same view of the clamp as shown in FIG. 4 except in the locked position. Lateral movement of anti-rotation bar 142 relative to aperture 140 as the clamp is engaged, can be seen in FIGS. 4 and 5. Anti-rotation bar 142 prevents rotation of cam follower 170 and locking disc 166 relative to housing 132.

Figure 6:
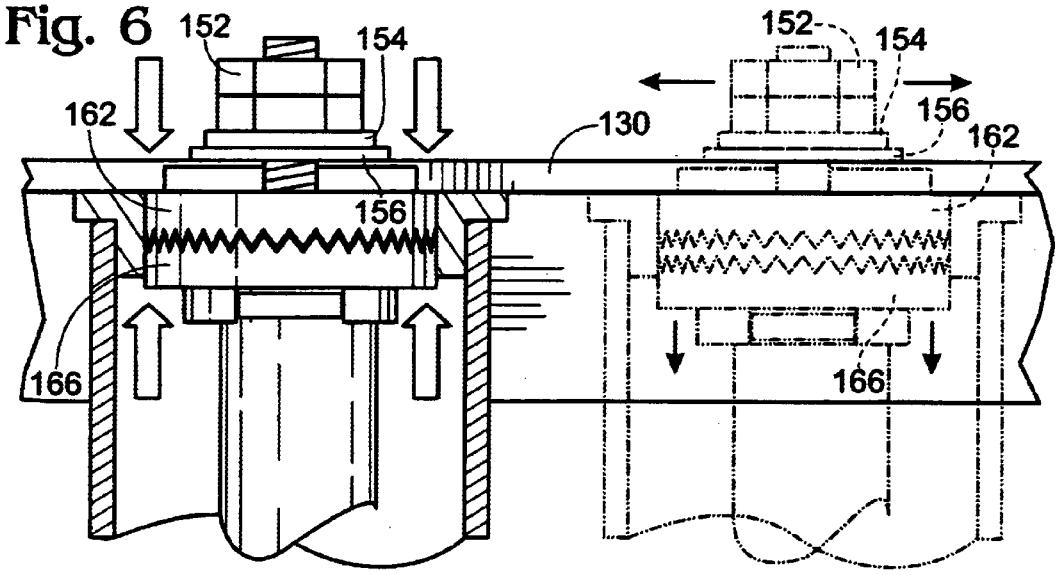
FIG. 6 is a partial cut-away view of a chest rest clamp illustrating how the clamp locks longitudinal movement.

FIG. 6 shows locking discs 162 and 166 engaged in solid lines, and disengaged in dashed lines. Movement of the clamp longitudinally relative to mounting brackets 130 is prevented when locking discs 162 and 166 are engaged and applying pressure in opposition to washers 156, 154, and nuts 152. Alternatively, when the clamp is unlocked, allowing disengagement of locking discs 162 and 166, the clamp is free to move longitudinally relative to mounting bracket 130. Nylon washer 156 minimized friction providing smooth adjustability when the clamp is unlocked. The distance between opposing nylon washers 156 on the outside of brackets 130 remains substantially constant through clamp operation so that chest rest 30 can be moved smoothly and squarely. Opposing nuts and washers are adjusted so that the chest rest does not fall or become loose when the clamp is unlocked, however the chest rest is easy to push or pull in a desired direction.

Figure 7:
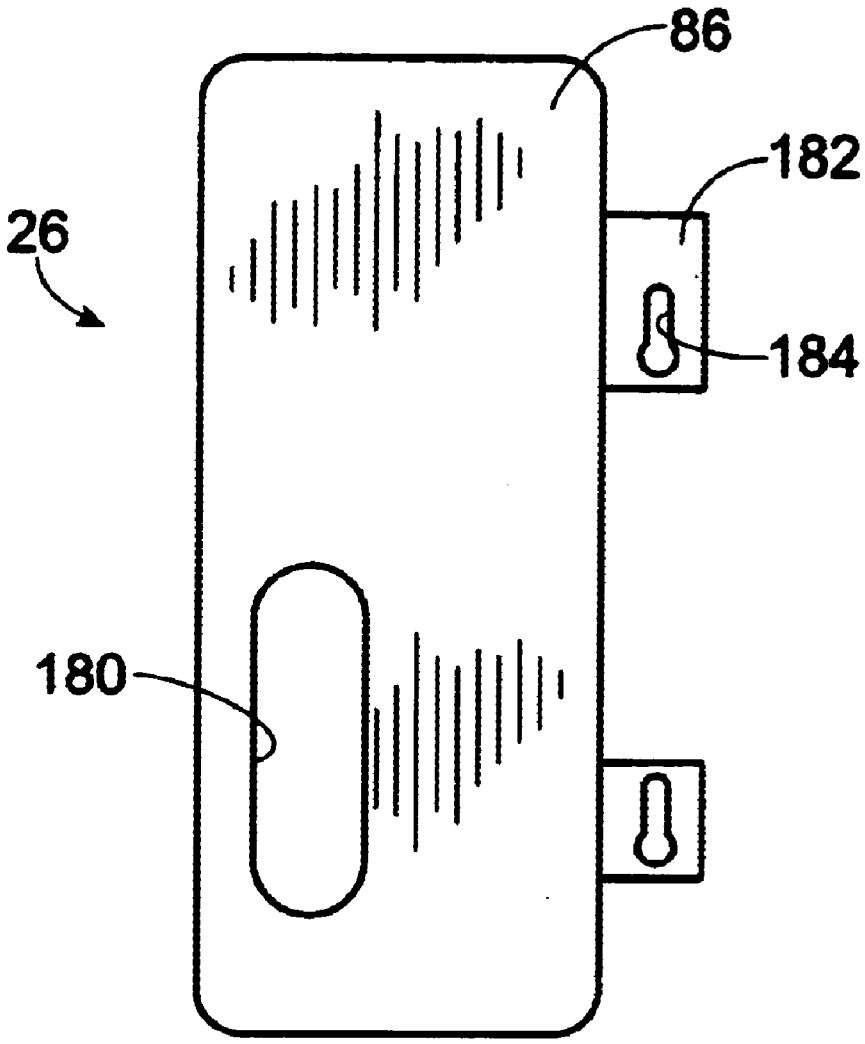
FIG. 7 is a bottom view, from the perspective of line 7—7 in FIG. 2, of a detachable knee support according to a preferred embodiment of the invention.
Figure 8:
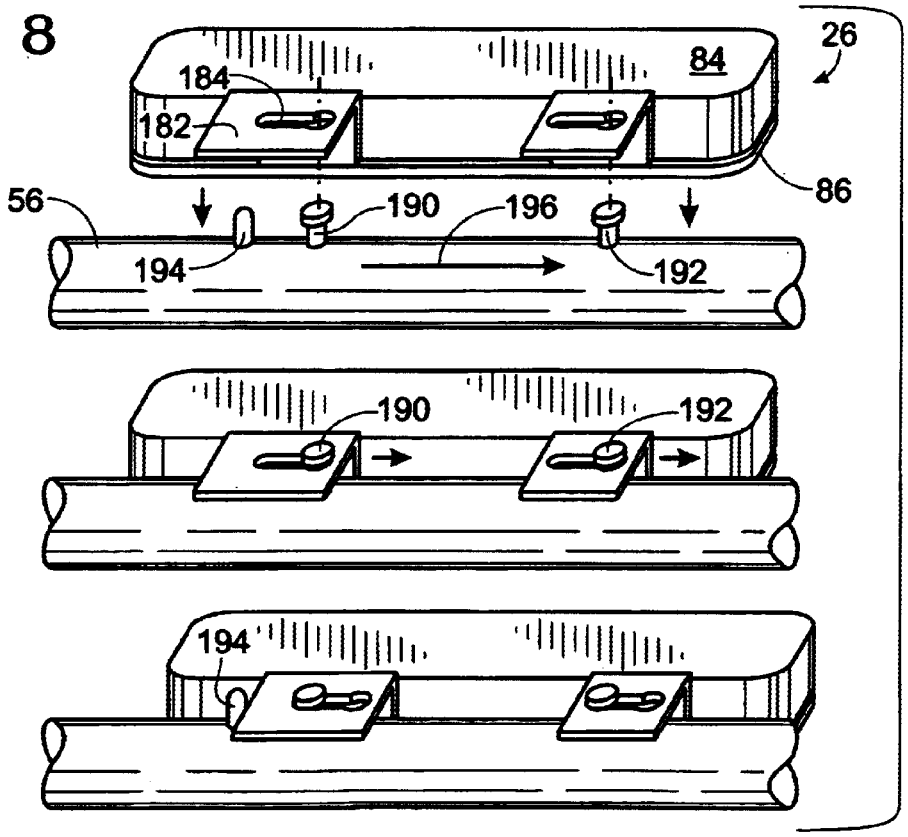
FIG. 8 shows a series of three perspective views of a detachable knee rest, illustrating a mechanism for locking the knee rest onto a cross support.

FIG. 7 shows the bottom side of knee rest 26 of FIG. 2. Knee rest 26 has a rigid planar base member 86. Base member 86 has a hand-sized aperture 180 which may be used to carry the chair when it is collapsed. A pair of flanges 182 are provided on a side of base member 86. Each flange 182 has a key-hole shaped slot 184 which has a variable width, i.e., a wide-width portion, and a narrow-width portion. FIG. 8 shows how knee rest 26 can be secured to transverse support member 56. Transverse support member 56 has a pair of T-shaped posts 190 and 192. T-shaped posts 190 and 192 are dimensioned so that they can be inserted through respective wide-width portions of apertures 184. Depressible spring biased pin 194 is then pushed down by the solid portion of flange 182 so that flanges 182 can slide in direction 196 until T-shaped posts 190 and 192 are registered with respect to narrow-width portions of slots 184, and pin 194 reemerges on the outside of flange 182. Knee rest 26 can be detached from transverse support member 56 by reversing the steps illustrated in FIG. 8.

FIGS. 9A–C illustrate how chair 20 is collapsed. In FIG. 9A chair 20 is set up for use. In FIG. 9B chair 20 is partially collapsed. In FIG. 9C chair 20 is completely collapsed. Chair 20 can be transported by leaning chair 20 forward so that wheels 70 are deployed in contact with the ground. Handle 72, as shown in FIG. 1, can be used to transport chair 20 by pulling the chair in a forward orientation so that it rolls on wheels 70. Alternatively, chair 20 may be carried in a sideways orientation by using one of the handles provided in knee rests 26, as shown in FIG. 7.

Figure 10:
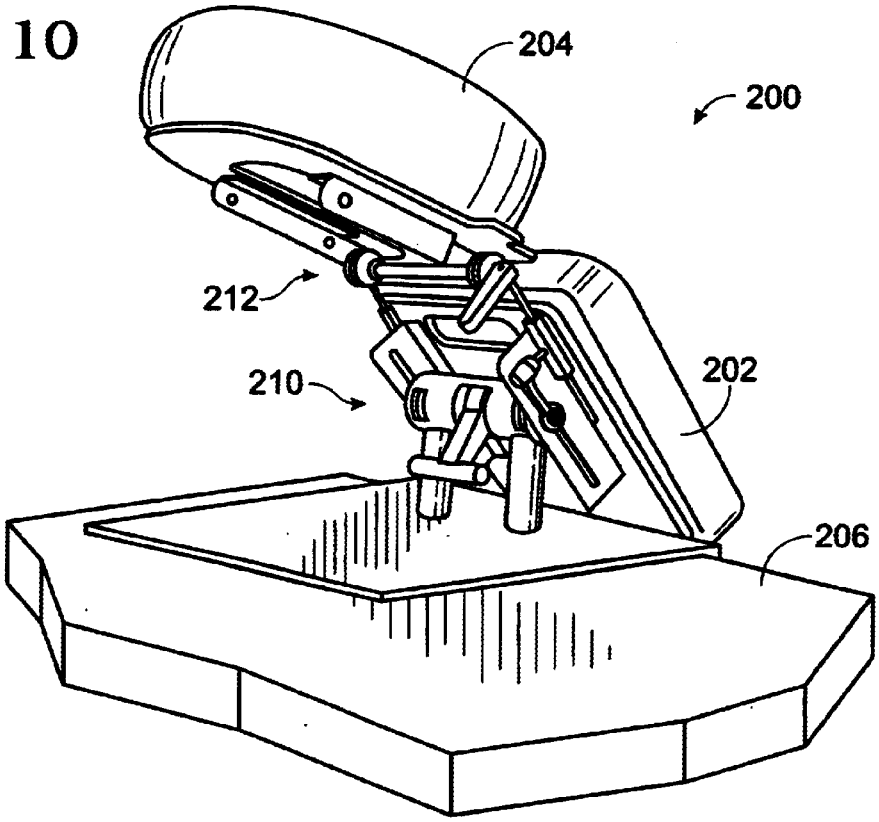
FIG. 10 shows an alternate embodiment of the invention connected to an edge of a table.

FIG. 10 shows an alternate embodiment of the invention. Chest and face rest support apparatus 200 includes adjustable chest rest 202 connected to adjustable face rest 204. Apparatus 200 is designed to clamp onto an edge of a rigid planar structure such as a tabletop 206. An adjustable chest rest clamp 210 is essentially the same as described previously and shown in FIGS. 3–6. Face rest 204 employs an adjustable clamp device 212 according to the details described in U.S. Pat. No. 5,427,436, and U.S. patent application Ser. No. 09/599,290, filed Jun. 21, 2000. Apparatus 200 may be used in conjunction with a standard chair (not shown).

Although the invention has been disclosed in its preferred forms, the specific embodiments thereof as disclosed and illustrated herein are not to be considered in a limiting sense, because numerous variations are possible. As used herein, singular terms do not preclude the use of more than one of the associated element, and embodiments using more than one of a particular element are within the spirit and scope of the invention. Applicant regards the subject matter of his invention to include all novel and nonobvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to the original claims, also are regarded as included within the subject matter of applicant's invention.

What is claimed is:

1. A chair comprising a seat, a front leg structure having an upper portion, a transverse axis being defined substantially perpendicular to the upper portion of the front leg structure, the transverse axis remaining fixed relative to the front leg structure;

a chest rest assembly having a support connected to the front leg structure along the transverse axis, and a clamp device that connects the chest rest assembly to the front leg structure, wherein the clamp device has a lock position and an unlock position so that when the clamp device is in the unlock position the chest rest assembly is free to slide in a plane that contains the transverse axis while also being free to rotate around the transverse axis, movement of the chest rest assembly relative to the transverse axis being substantially locked when the clamp device is in the locked position.

2. The chair of claim 1, wherein the clamp device can be operated between the lock and unlock positions by operating a single handle.

3. The chair of claim 2, wherein the handle is a cam lever.

4. The chair of claim 2, wherein the handle is centrally located on the back side of the chest rest.

5. The chair of claim 1 further comprising a face rest connected to the chest rest.

6. The chair of claim 5 further comprising a slide mechanism that permits alteration of a distance between the chest rest and the face rest.

7. The chair of claim 5 further comprising a second clamp device that permits alteration of the orientation of the face rest relative to the chest rest.

8. The chair of claim 1 further comprising a pair of detachable knee rests positioned substantially below and forward from the seat.

9. The chair of claim 1 further comprising a rear leg framework supporting the seat.

10. The chair of claim 9, wherein the rear leg framework has a pair of distal tips, each distal tip having a wheel device connected substantially perpendicular to the framework so that when the chair is set up, the wheels do not contact the ground, and when the chair is collapsed, the wheels contact the ground for easy transport.

11. The chair of claim 1 further comprising a seat leveling mechanism that permits the orientation of the seat to be altered relative to a diagonal support beam.

12. The chair of claim 1, wherein the clamp device includes plural sets of locking discs positioned along the common axis, each set of discs being engaged when the clamp device is locked and separated when the clamp device is unlocked, thereby permitting movement of the chest rest assembly relative to the front leg structure, and a handle located between the sets of locking discs, the handle being movable between first and second positions to lock and unlock the clamping device by operating the sets of locking discs simultaneously.

* * * * *